US007744548B2

(12) United States Patent
Chen

(10) Patent No.: US 7,744,548 B2
(45) Date of Patent: Jun. 29, 2010

(54) MASSAGING DEVICE HAVING RECIPROCALLY DEFLECTIVE MASSAGING FUNCTION

(75) Inventor: Yuan-Chuen Chen, Changhua Hsien (TW)

(73) Assignee: Hsin Hao Health Materials Co., Ltd., Changhua Hsien (TW)

( * ) Notice: Subject to any disclaimer, the term of this patent is extended or adjusted under 35 U.S.C. 154(b) by 1104 days.

(21) Appl. No.: 11/409,176

(22) Filed: Apr. 21, 2006

(65) Prior Publication Data

US 2007/0078362 A1 Apr. 5, 2007

(30) Foreign Application Priority Data

Sep. 30, 2005 (TW) ..... 94216971 U

(51) Int. Cl.
*A61H 7/00* (2006.01)

(52) U.S. Cl. ..... 601/90; 601/92; 601/94; 601/98; 601/103; 601/133; 601/134

(58) Field of Classification Search ..... 601/90, 601/92–95, 98–103, 133, 134
See application file for complete search history.

(56) References Cited

U.S. PATENT DOCUMENTS 6,213,962 B1 * 4/2001 Shimizu ..... 601/90
6,808,500 B1 * 10/2004 Cheng-Yi et al. ..... 601/99
7,041,070 B2 * 5/2006 Hsieh ..... 601/90
7,147,611 B2 * 12/2006 Kassel et al. ..... 601/90
7,179,239 B2 * 2/2007 Chang ..... 601/90
2004/0186399 A1 * 9/2004 Tseng ..... 601/112

* cited by examiner

*Primary Examiner*—Danton DeMille
(74) *Attorney, Agent, or Firm*—Alan Kamrath; Kamrath & Associates PA

(57) ABSTRACT

A massaging device includes a propeller shaft, at least one first swinging member mounted on the propeller shaft, and at least one second swinging member mounted on the propeller shaft by a male deflection block, a female deflection block and an adjusting rod. Thus, when the rotation direction of the propeller shaft is changed, the push block of the adjusting rod is slidable in the adjusting groove of the male deflection block to produce a time lag of the swinging actions between the second swinging member and the first swinging member, so that the second swinging member and the first swinging member are operated in the same swinging direction or in two different swinging directions so as to produce different swinging actions, thereby providing different massaging effects to the user.

15 Claims, 9 Drawing Sheets

MASSAGING DEVICE HAVING RECIPROCALLY DEFLECTIVE MASSAGING FUNCTION

BACKGROUND OF THE INVENTION

1. Field of the Invention

The present invention relates to a massaging device, and more particularly to a massaging device having a reciprocally deflective massaging function.

2. Description of the Related Art

A conventional massaging device comprises two pairs of swinging members that are swingable to produce a sector-shaped swinging motion to press a user's two legs or arms to provide a massaging effect, and a drive shaft connected to the swinging members to drive the swinging members. However, the swinging members are swung in the same direction, so that the massaging effect caused by the swinging members is limited to a determined extent, thereby decreasing the massaging effect of the massaging device.

BRIEF SUMMARY OF THE INVENTION

In accordance with the present invention, there is provided a massaging device, comprising a propeller shaft, at least one first swinging member mounted on the propeller shaft, and at least one second swinging member mounted on the propeller shaft by a male deflection block, a female deflection block and an adjusting rod.

The primary objective of the present invention is to provide a massaging device having a reciprocally deflective massaging function.

Another objective of the present invention is to provide a massaging device, wherein when the rotation direction of the propeller shaft is changed, the push block of the adjusting rod is slidable in the adjusting groove of the male deflection block to produce a time (or angle) lag of the swinging actions between the second swinging member and the first swinging member, so that the second swinging member and the first swinging member are intermittently operated in the same swinging direction or in two different swinging directions, so as to produce different swinging actions in an intermittent manner, thereby providing different massaging effects to the user.

A further objective of the present invention is to provide a massaging device, wherein the guide rod of each of the first swinging member and the second swinging member is movable in the respective guide track of the support base to guide the swinging movement of each of the first swinging member and the second swinging member, so that the first swinging member and the second swinging member are swung in a smooth manner, thereby providing a comfortable sensation to the user.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
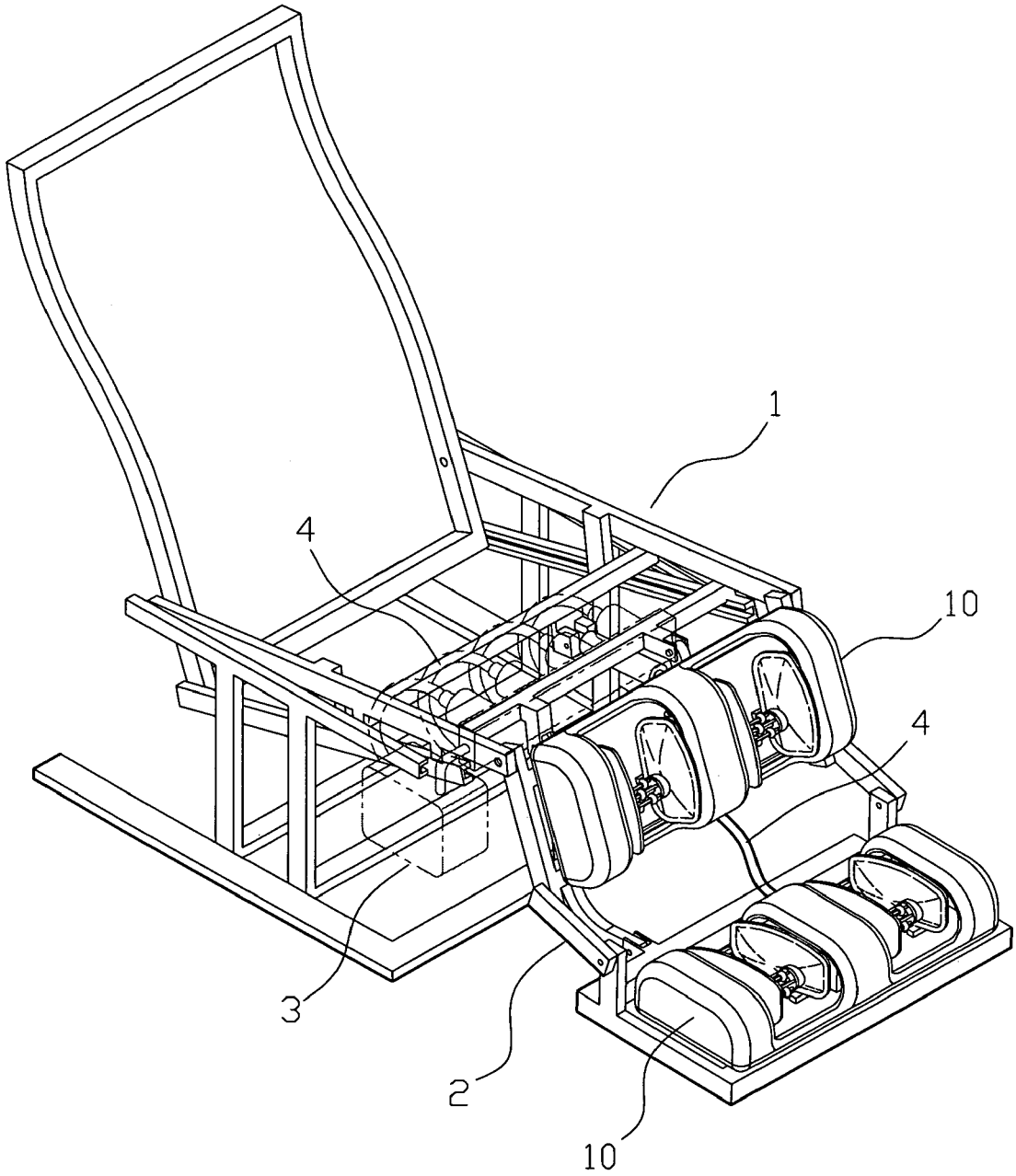
FIG. 1 is a perspective view of a massaging device for a massaging chair in accordance with the preferred embodiment of the present invention.
Figure 2:
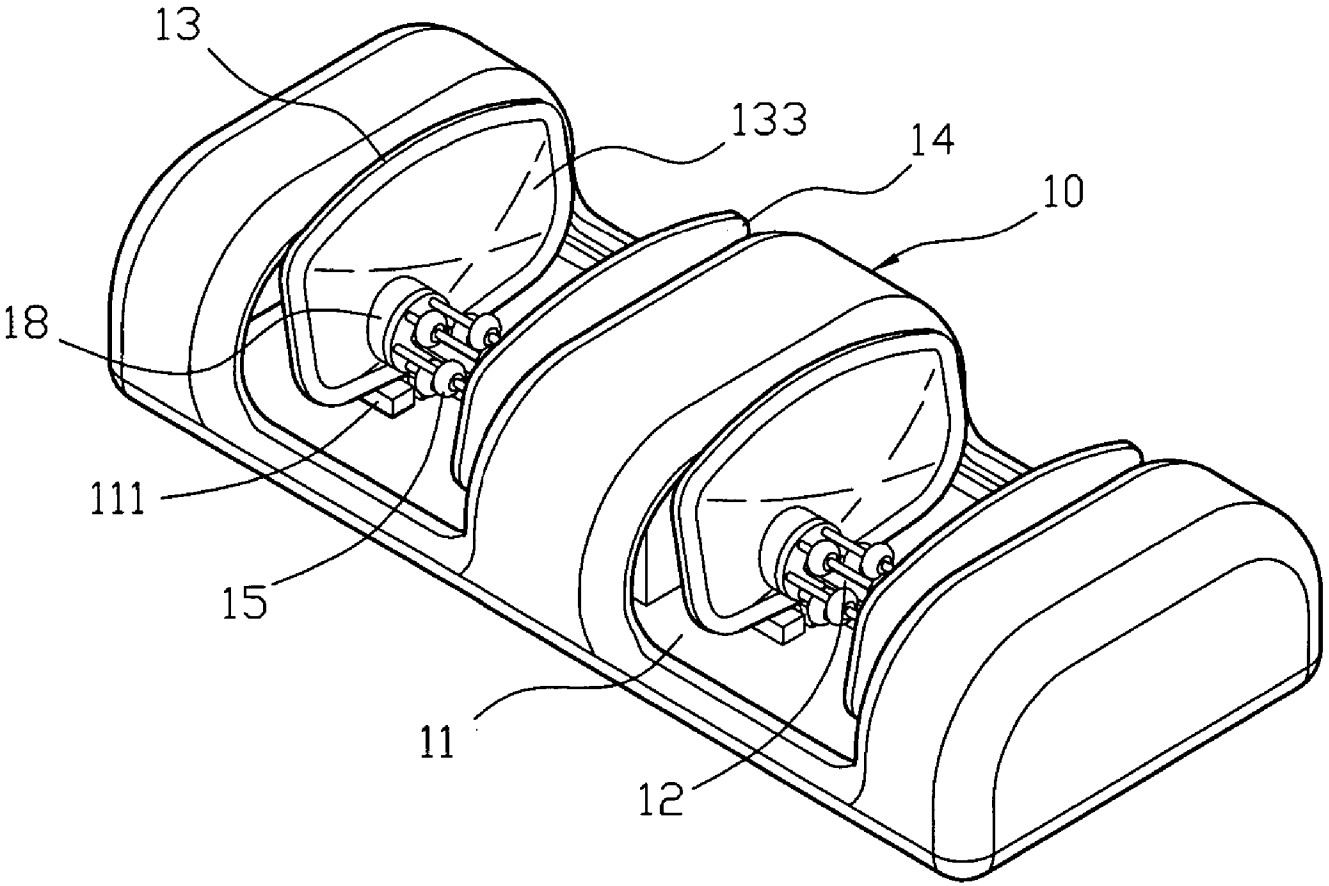
FIG. 2 is a perspective view of the massaging device in accordance with the preferred embodiment of the present invention.
Figure 3:
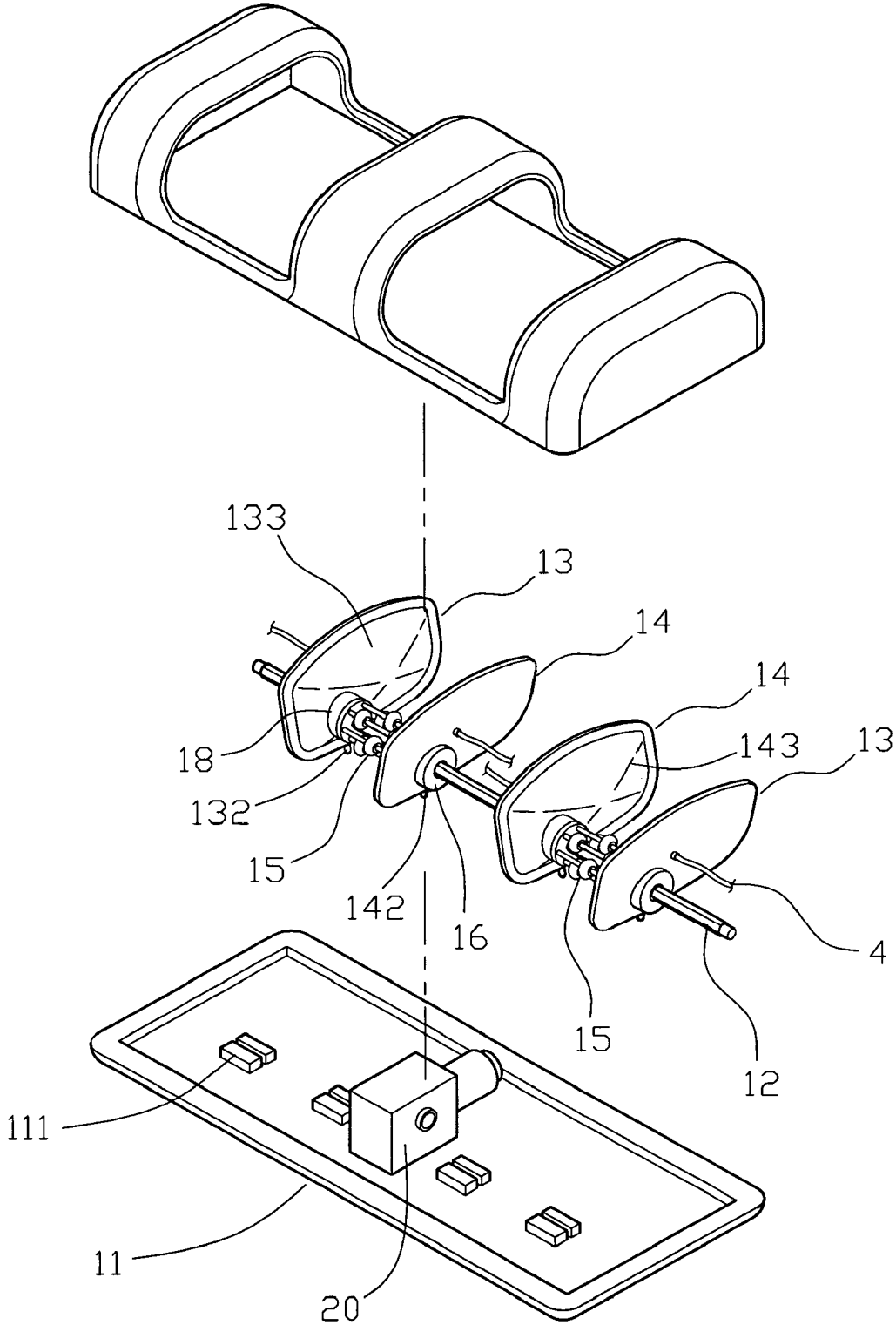
FIG. 3 is a partially exploded perspective view of the massaging device as shown in FIG. 2.
Figure 4:
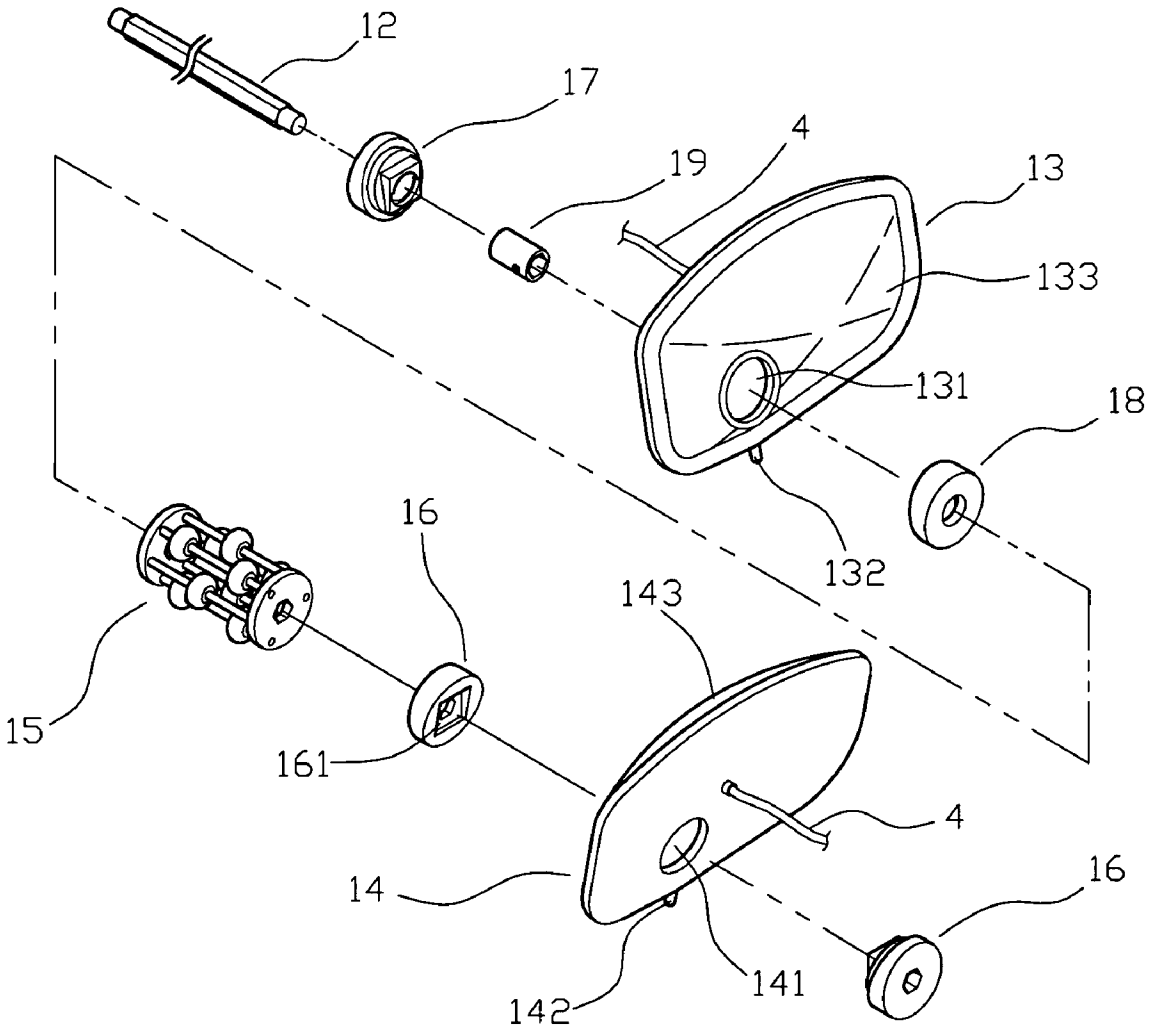
FIG. 4 is a partially exploded perspective view of the massaging device as shown in FIG. 3.
Figure 5:
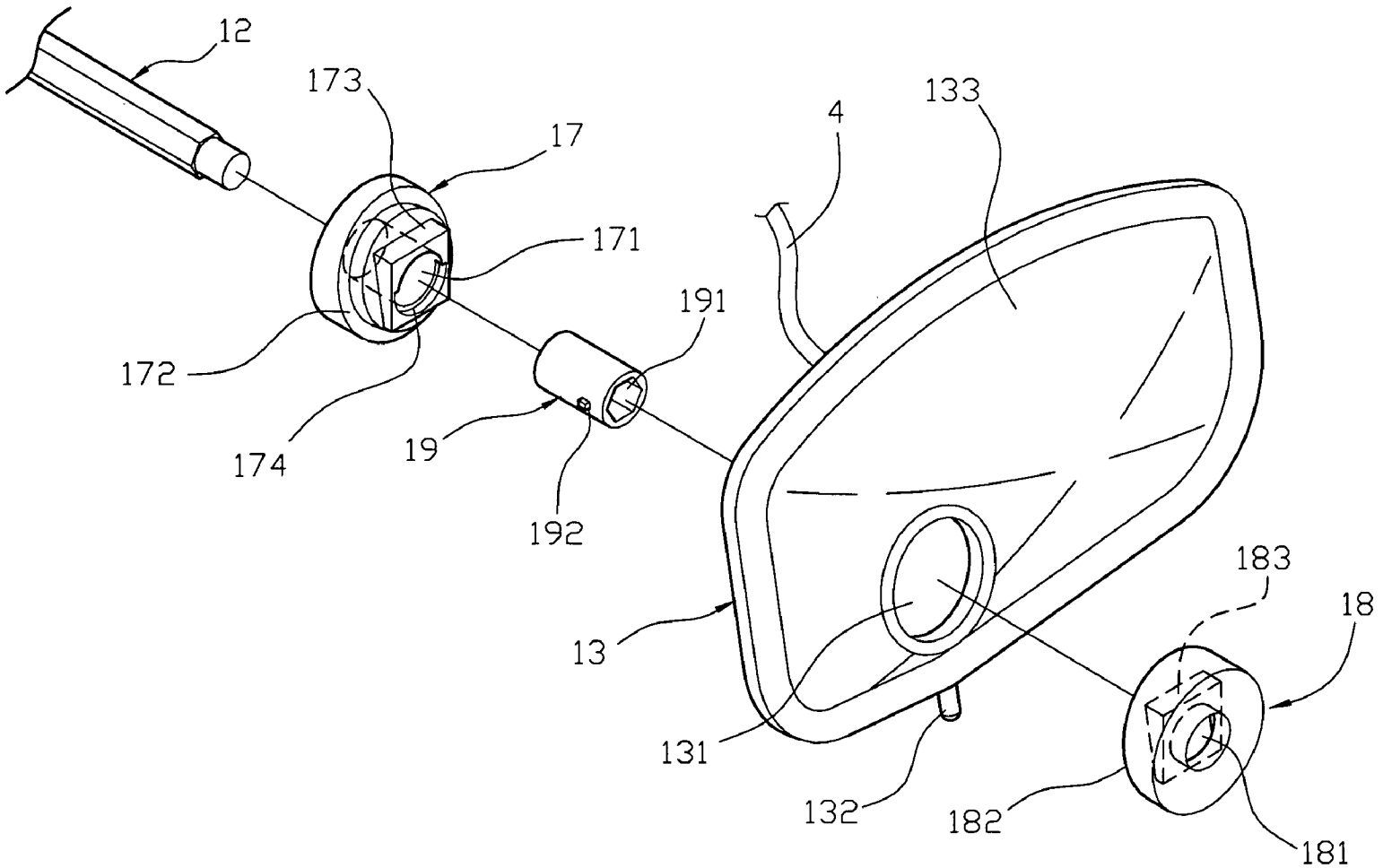
FIG. 5 is a partially exploded perspective view of the massaging device as shown in FIG. 4.
Figure 6:
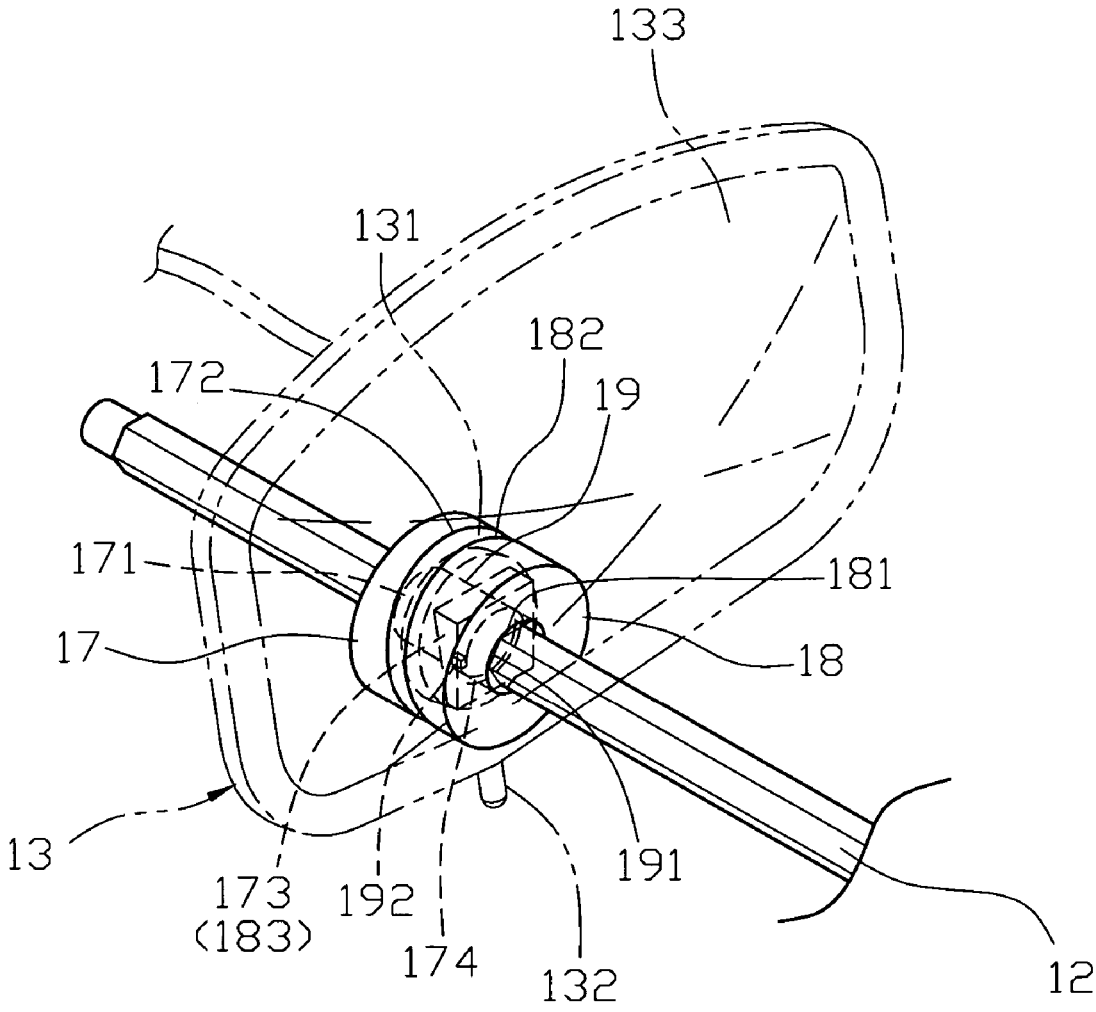
FIG. 6 is a perspective assembly view of the massaging device as shown in FIG. 5.

Referring to the drawings and initially to FIG. 1, a massaging device 10 in accordance with the present invention is mounted on a massaging chair 1 and located adjacent to a leg support frame 2 of the massaging chair 1 to massage a user's legs. The massaging chair 1 includes an inflation device 3 connected to the massaging device 10 by a plurality of pipes 4 to provide an inflation function to the massaging device 10. Alternatively, the massaging device 10 is used individually to massage a user's arms.

Referring to FIGS. 2-6, the massaging device 10 in accordance with the preferred embodiment of the present invention comprises a support base 11, a drive mechanism 20 mounted on the support base 11, a propeller shaft 12 mounted on and rotated by the drive mechanism 20, at least one first swinging member 14 mounted on the propeller shaft 12, at least one second swinging member 13 mounted on the propeller shaft 12 by a male deflection block 17, a female deflection block 18 and an adjusting rod 19, and at least one massaging roll 15 secured on the propeller shaft 12 to rotate therewith and located between the first swinging member 14 and the second swinging member 13. In the preferred embodiment of the present invention, the massaging device 10 comprises two first swinging members 14, two second swinging members 13 and two massaging rolls 15.

The support base 11 has a surface provided with a plurality of guide tracks 111. The propeller shaft 12 has a substantially polygonal cross-sectional profile.

The first swinging member 14 has an end portion formed with a mounting hole 141 mounted on the propeller shaft 12 and has a periphery provided with a guide rod 142 movably mounted in a respective one of the guide tracks 111 of the support base 11 to guide a swinging movement of the first swinging member 14. The first swinging member 14 has a side face provided with an inflatable cell 143 which is connected to the inflation device 3 of the massaging chair 1 by one of the pipes 4.

The first swinging member 14 is clamped between two juxtaposed deflection blocks 16 which are secured on the propeller shaft 12 to rotate therewith. Each of the two deflection blocks 16 has a side formed with tapered clamping face 161 rested on the first swinging member 14, so that when the two deflection blocks 16 are rotated with the propeller shaft 12, the first swinging member 14 is pressed by the tapered clamping faces 161 of the two deflection blocks 16 to produce a swinging action.

The second swinging member 13 has an end portion formed with a mounting hole 131 and has a periphery provided with a guide rod 132 movably mounted in a respective one of the guide tracks 111 of the support base 11 to guide a swinging movement of the second swinging member 13. The second swinging member 13 has a side face provided with an inflatable cell 133 which is connected to the inflation device 3 of the massaging chair 1 by one of the pipes 4.

The second swinging member 13 is clamped between the male deflection block 17 and the female deflection block 18 which are juxtaposed to each other. Bach of the male deflection block 17 and the female deflection block 18 has a side formed with tapered clamping face 172 and 182 rested on the second swinging member 13, 50 that when the male deflection block 17 and the female deflection block 18 arc rotated, the second swinging member 13 is pressed by the tapered clamping faces 172 and 182 of the male deflection block 17 and the female deflection block 18 to produce a swinging action.

The adjusting rod 19 has an outer wall provided with a protruding push block 192. The adjusting rod 19 has an inner wall formed with a fixing hole 191 secured on the propeller shaft 12 to rotate therewith so that the adjusting rod 19 is rotatable by the propeller shaft 12. The fixing hole 191 of the adjusting rod 19 has a substantially polygonal cross-sectional profile matching that of the propeller shaft 12.

The male deflection block 17 has an inside formed with a circular mounting bore 171 mounted on the adjusting rod 19 and has an end wall formed with a substantially arc-shaped adjusting groove 174 connected to the mounting bore 171 to receive the push block 192 of the adjusting rod 19. The end wall of the male deflection block 17 is provided with a protruding insert 173 extended through and protruded from the mounting hole 131 of the second swinging member 13, and the adjusting groove 174 is located in the insert 173.

The female deflection block 18 has an inside formed with a circular mounting bore 181 mounted on the adjusting rod 19 and has an end wall formed with a slot 183 to allow insertion of the insert 173 of the male deflection block 17 so that the male deflection block 17 and the female deflection block 18 are joined together and are rotatable simultaneously.

Figure 7:
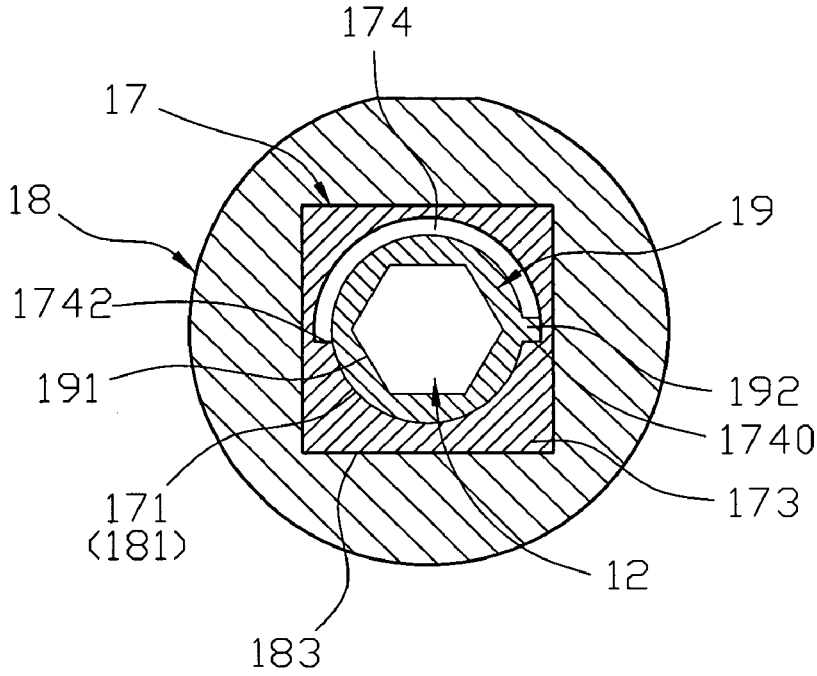
FIG. 7 is a plan cross-sectional view of the massaging device as shown in FIG. 6.
Figure 9:
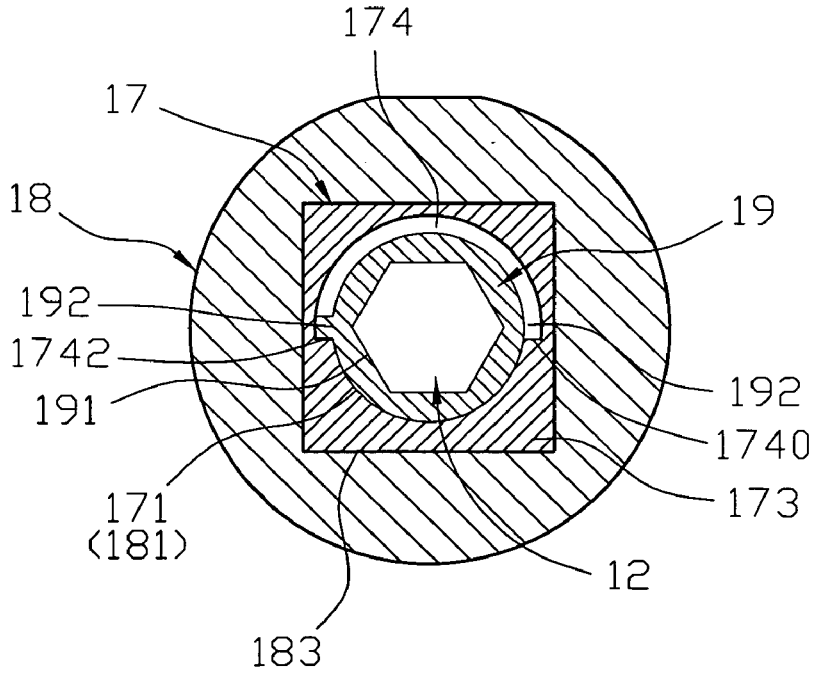
FIG. 9 is a schematic operational view of the massaging device as shown in FIG. 7.

Thus, the adjusting rod 19 is rotatable by the propeller shaft 12 between a first position as shown in FIG. 7 where the push block 192 of the adjusting rod 19 is rested on a first side 1740 of the adjusting groove 174 of the male deflection block 17, so that the male deflection block 17 together with the female deflection block 18 is driven by the adjusting rod 19 to rotate in a first direction, and a second position as shown in FIG. 9 where the push block 192 of the adjusting rod 19 is rested on a second side 1742 of the adjusting groove 174 of the male deflection block 17, so that the male deflection block 17 together with the female deflection block 18 is driven by the adjusting rod 19 to rotate in a second direction opposite to the first direction.

Figure 8:
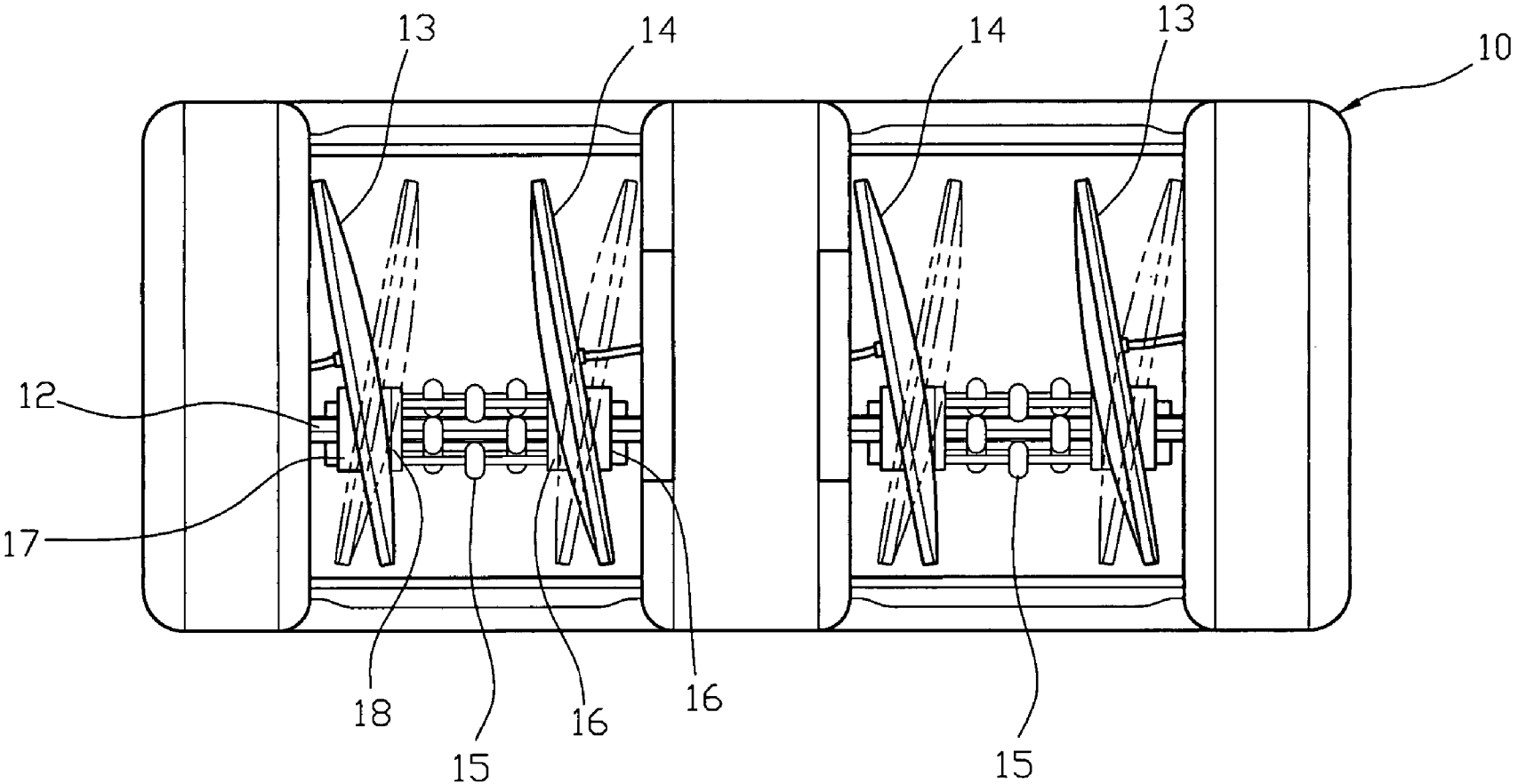
FIG. 8 is a top plan operational view of the massaging device as shown in FIG. 2.

In operation, referring to FIGS. 7 and 8 with reference to FIGS. 1-6, when the propeller shaft 12 is rotated in the clockwise direction as shown in FIG. 7, the push block 192 of the adjusting rod 19 is rested on the first side 1740 of the adjusting groove 174 of the male deflection block 17, so that the male deflection block 17 together with the female deflection block 18 is driven by the adjusting rod 19 to rotate in the clockwise direction. At the same time, the deflection blocks 16 are directly driven by the propeller shaft 12 to rotate in the clockwise direction.

In such a manner, when the propeller shaft 12 is rotated in the clockwise direction as shown in FIG. 7, the deflection blocks 16 are directly driven by the propeller shaft 12 to rotate in the clockwise direction to drive the first swinging member 14 to produce a swinging action, while the male deflection block 17 and the female deflection block 18 are driven by the adjusting rod 19 to rotate in the clockwise direction to drive the second swinging member 13 to produce a swinging action.

Thus, when the propeller shaft 12 is rotated in the clockwise direction as shown in FIG. 7, the first swinging member 14 and the second swinging member 13 are driven simultaneously to produce a swinging action in the same direction as shown in FIG. 8.

Figure 10:
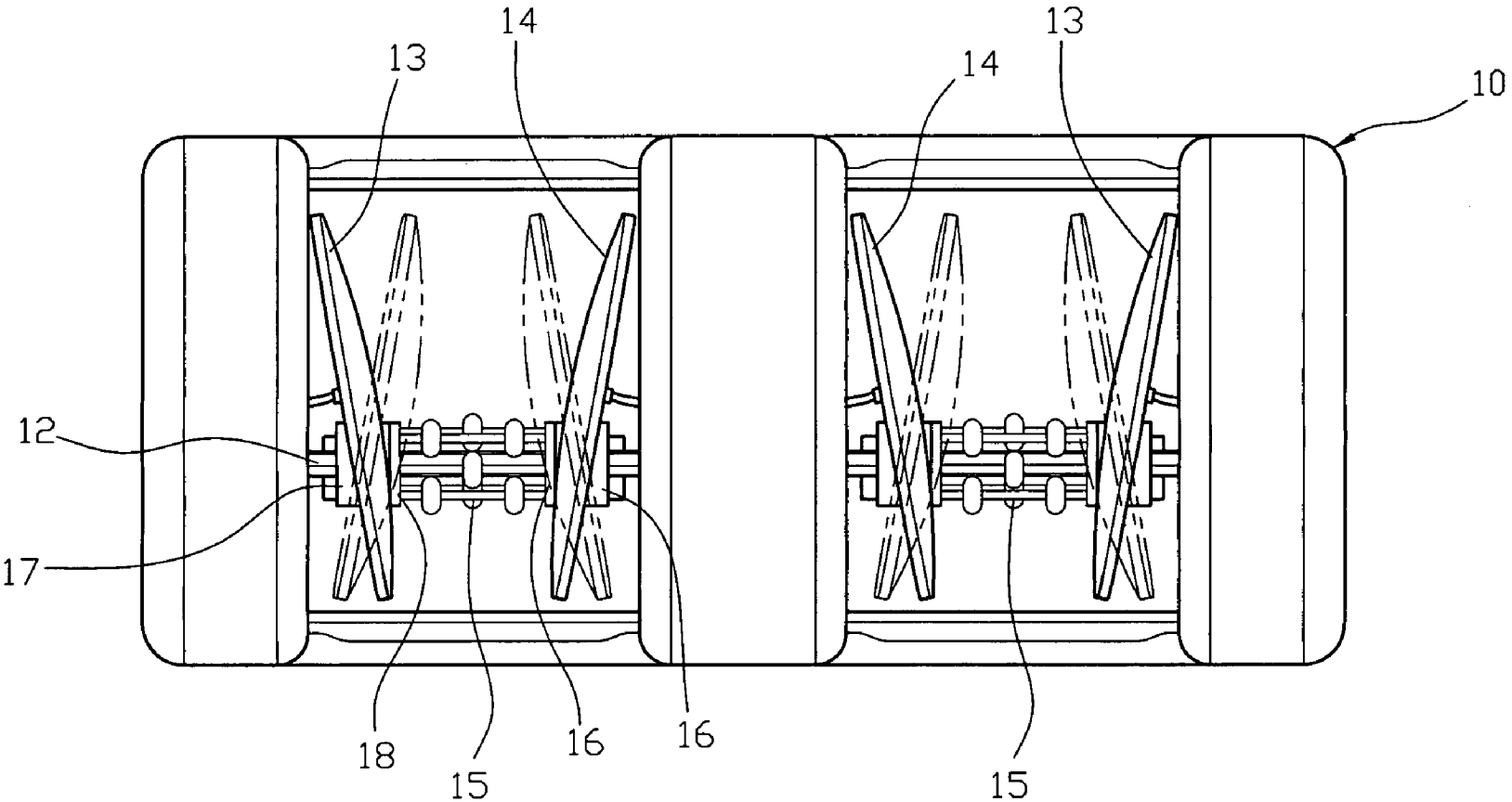
FIG. 10 is a schematic operational view of the massaging device as shown in FIG. 8.

On the contrary, referring to FIGS. 9 and 10 with reference to FIGS. 1-6, when the propeller shaft 12 is rotated in the counterclockwise direction, the deflection blocks 16 are directly driven by the propeller shaft 12 to rotate in the counterclockwise direction to drive the first swinging member 14 to produce a swinging action successively. At the same time, the push block 192 of the adjusting rod 19 is slidable in the adjusting groove 174 of the male deflection block 17, so that the male deflection block 17 together with the female deflection block 18 is not driven by the adjusting rod 19 to perform an idle action, and the second swinging member 13 is kept at a stationary state.

When the push block 192 of the adjusting rod 19 is movable to rest on the second side 1742 of the adjusting groove 174 of the male deflection block 17 as shown in FIG. 9, the male deflection block 17 together with the female deflection block 18 is driven by the adjusting rod 19 to rotate in the counterclockwise direction to drive the second swinging member 13 to produce a swinging action. At this time, the swinging direction of the second swinging member 13 is opposite to that of the first swinging member 14.

Thus, when the propeller shaft 12 is rotated in the counterclockwise direction as shown in FIG. 9, the first swinging member 14 and the second swinging member 13 are driven to produce a swinging action with a time lag, so that the swinging direction of the second swinging member 13 is opposite to and different from that of the first swinging member 14 as shown in FIG. 10.

Accordingly, when the rotation direction of the propeller shaft 12 is changed, the push block 192 of the adjusting rod 19 is slidable in the adjusting groove 174 of the male deflection block 17 to produce a time (or angle) lag of the swinging actions between the second swinging member 13 and the first swinging member 14, so that the second swinging member 13 and the first swinging member 14 are intermittently operated in the same swinging direction or in two different swinging directions, so as to produce different swinging actions in an intermittent manner, thereby providing different massaging effects to the user. In addition, the guide rod 142 and 132 of each of the first swinging member 14 and the second swinging member 13 is movable in the respective guide track 111 of the support base 11 to guide the swinging movement of each of the first swinging member 14 and the second swinging member 13, so that the first swinging member 14 and the second swinging member 13 are swung in a smooth manner, thereby providing a comfortable sensation to the user.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A massaging device, comprising:

a propeller shaft;

at least one first swinging member mounted on the propeller shaft;

at least one second swinging member mounted on the propeller shaft by a male deflection block, a female deflection block and an adjusting rod;

wherein the adjusting rod has an inner wall formed with a fixing hole secured on the propeller shaft to rotate with the propeller shaft so that the adjusting rod is rotatable by the propeller shaft;

the adjusting rod has an outer wall provided with a protruding push block;

the male deflection block has an inside formed with a mounting bore mounted on the outer wall of the adjusting rod and has an end wall formed with an adjusting groove connected to the mounting bore to receive and guide movement of the push block of the adjusting rod and to guide rotation of the adjusting rod relative to the male deflection block;

the second swinging member has an end portion formed with a mounting hole;

the end wall of the male deflection block is provided with a protruding insert extended through and protruded from the mounting hole of the second swinging member;

the female deflection block has an end wall formed with a slot to allow insertion of the insert of the male deflection block so that the male deflection block and the female deflection block are joined together and are rotatable simultaneously;

the insert of the male deflection block has a substantially square profile;

the slot of the female deflection block has a substantially square profile matching that of the insert of the male deflection block so that the slot of the female deflection block is secured on the insert of the male deflection block, and the female deflection block is secured on the insert of the male deflection block to rotate in concert with the male deflection block;

the propeller shaft has a substantially hexagonal cross-sectional profile;

the fixing hole of the adjusting rod has a substantially hexagonal cross-sectional profile matching that of the propeller shaft so that the fixing hole of the adjusting rod is secured on the propeller shaft.

2. The massaging device in accordance with claim 1, wherein the second swinging member is clamped between the male deflection block and the female deflection block which are juxtaposed to each other.

3. The massaging device in accordance with claim 1, wherein each of the male deflection block and the female deflection block has a side formed with tapered clamping face rested on the second swinging member, so that when the male deflection block and the female deflection block are rotated, the second swinging member is pressed by the tapered clamping faces of the male deflection block and the female deflection block to produce a swinging action;

the second swinging member is non-rotatable by rotation of the male deflection block and the female deflection block.

4. The massaging device in accordance with claim 1, wherein the adjusting rod is rotatable relative to the male deflection block and the female deflection block between a first position where the push block of the adjusting rod is rested on a first side of the adjusting groove of the male deflection block, so that the male deflection block together with the female deflection block is driven by the adjusting rod to rotate relative to the second swinging member in a first direction, and a second position where the push block of the adjusting rod is rested on a second side of the adjusting groove of the male deflection block, so that the male deflection block together with the female deflection block is driven by the adjusting rod to rotate relative to the second swinging member in a second direction opposite to the first direction.

5. The massaging device in accordance with claim 1, wherein the adjusting groove of the male deflection block is substantially arc-shaped.

6. The massaging device in accordance with claim 1, wherein the adjusting groove is located in the insert and surrounds the mounting bore of the male deflection block.

7. The massaging device in accordance with claim 1, wherein the female deflection block has an inside formed with a mounting bore mounted on the outer wall of the adjusting rod;

the outer wall of the adjusting rod has a substantially circular profile;

the mounting bore of the male deflection block has a substantially circular profile matching that of the outer wall of the adjusting rod so that the adjusting rod is rotatable relative to the male deflection block;

the mounting bore of the female deflection block has a substantially circular profile matching that of the outer wall of the adjusting rod so that the adjusting rod is rotatable relative to the female deflection block.

8. The massaging device in accordance with claim 1, wherein the first swinging member is clamped between two juxtaposed deflection blocks which are secured on the propeller shaft to rotate therewith, and each of the two deflection blocks has a side formed with tapered clamping face rested on the first swinging member, so that when the two deflection blocks are rotated with the propeller shaft, the first swinging member is pressed by the tapered clamping faces of the two deflection blocks to produce a swinging action;

each of the two deflection blocks has an inside formed with a through hole which has a substantially hexagonal cross-sectional profile matching that of the propeller shaft so that the through hole of each of the two deflection blocks is secured on the propeller shaft.

9. The massaging device in accordance with claim 1, wherein the push block of the adjusting rod is slidable in and guided by the adjusting groove of the male deflection block when a rotation direction of the propeller shaft is changed to produce a time lag of swinging actions between the second swinging member and the first swinging member, so that the second swinging member and the first swinging member are operated in the same swinging direction or in two different swinging directions.

10. The massaging device in accordance with claim 1, wherein the push block of the adjusting rod is slidable in and guided by the adjusting groove of the male deflection block when a rotation direction of the propeller shaft is changed, so that the male deflection block is not driven by the adjusting rod to perform an idle action, and the second swinging member is kept at a stationary state.

11. The massaging device in accordance with claim 1, further comprising at least one massaging roll secured on the propeller shaft to rotate therewith and located between the first swinging member and the second swinging member, wherein the at least one massaging roll has an inside formed with a through hole which has a substantially hexagonal cross-sectional profile matching that of the propeller shaft so that the through hole of the at least one massaging roll is secured on the propeller shaft.

12. The massaging device in accordance with claim 1, further comprising a support base having a surface provided with a plurality of guide tracks, and each of the first swinging member and the second swinging member has a periphery provided with a guide rod movably mounted in a respective one of the guide tracks of the support base to guide a swinging movement of each of the first swinging member and the second swinging member.

13. The massaging device in accordance with claim 12, further comprising a drive mechanism mounted on the support base, wherein the propeller shaft is mounted on and rotated by the drive mechanism.

14. The massaging device in accordance with claim 1, wherein each of the first swinging member and the second swinging member has a side face provided with an inflatable cell which is connected to an inflation device by a pipe.

15. The massaging device in accordance with claim 1, wherein the first swinging member has an end portion formed with a mounting hole mounted on the propeller shaft;

the mounting hole of the first swinging member extends through a whole thickness of the first swinging member;

the mounting hole of the second swinging member extends through a whole thickness of the second swinging member.

* * * * *